US006799406B2

(12) United States Patent
Gosselin et al.

(10) Patent No.: US 6,799,406 B2
(45) Date of Patent: Oct. 5, 2004

(54) BOLTED METAL JOIST AND METHOD OF MANUFACTURING THE SAME

(75) Inventors: Georges Gosselin, Otterburn Park (CA); Vladimir Gocevski, Beaconsfield (CA)

(73) Assignee: Bolmetco Inc., Otterburn Park (CA)

( * ) Notice: Subject to any disclaimer, the term of this patent is extended or adjusted under 35 U.S.C. 154(b) by 0 days.

(21) Appl. No.: 09/983,043

(22) Filed: Oct. 22, 2001

(65) Prior Publication Data

US 2002/0069606 A1 Jun. 13, 2002

Related U.S. Application Data

(63) Continuation of application No. PCT/CA00/00447, filed on Apr. 20, 2000.

(30) Foreign Application Priority Data

Apr. 22, 1999 (CA) ..... 2271403

(51) Int. Cl.[7] ..... E04C 3/02; E04C 3/30

(52) U.S. Cl. ..... 52/694; 52/695; 52/696; 52/697; 52/724.1; 52/731.7

(58) Field of Search ..... 52/690, 693, 694–696, 52/724.3, 730.4, 730.5, 731.1, 731.5, 697, 731.7, 691, 692, 634, 636; 403/217, 219

(56) References Cited

U.S. PATENT DOCUMENTS

| | | | | |
|---|---|---|---|---|
| 513,187 A | | 1/1894 | Joly | |
| 1,839,178 A | | 12/1931 | Rebman | |
| 1,865,059 A | * | 6/1932 | Ragsdale | |
| 2,136,071 A | * | 11/1938 | Braden | |
| 2,146,540 A | * | 2/1939 | Hwhn et al. | |
| 2,284,898 A | * | 6/1942 | Hartman | |
| 2,405,917 A | * | 8/1946 | Watter | |
| 2,514,607 A | * | 7/1950 | Mclean | |
| 3,122,224 A | * | 2/1964 | Blickensderfer | |
| 3,221,467 A | * | 12/1965 | Henkels | |
| 3,673,658 A | | 7/1972 | Hagen | |
| 4,621,475 A | * | 11/1986 | McClain | 52/693 |
| 4,887,406 A | * | 12/1989 | Saia | 52/694 |
| 5,003,748 A | * | 4/1991 | Carr | 52/693 |
| 5,974,759 A | * | 11/1999 | Burger | 52/695 |

FOREIGN PATENT DOCUMENTS

| | | |
|---|---|---|
| CH | 381 838 A | 11/1964 |
| CH | 431 438 A | 8/1967 |
| DE | 19 61 696 A | 6/1971 |
| GB | 493 635 A | 11/1938 |
| GB | 888 798 A | 2/1962 |
| GB | 983 467 A | 2/1965 |

* cited by examiner

*Primary Examiner*—Carl D. Friedman
*Assistant Examiner*—Yvonne M. Horton
(74) *Attorney, Agent, or Firm*—Ogilvy Renault; Robert Mitchell

(57) ABSTRACT

A joist (10) comprises an upper chord (12), a lower chord (14) and a plurality of compression and tension webs (16/18) extending between the chords (12/14) and secured thereto by means of bolts (50). A single bolt (50) per connection or nodal point is used to secure the compression and tension webs (16/18) to the chords (12/14). The metal joist (10) can easily be assembled in a shop or directly on site without highly qualified labor.

12 Claims, 7 Drawing Sheets

BOLTED METAL JOIST AND METHOD OF MANUFACTURING THE SAME

RELATED APPLICATIONS

This is a continuation of Internatational PCT Application No. PCT/CA00/00447 filed on Apr. 20, 2000, which claims the benefit of Canadian Application No. 2,271,403.

BACKGROUND OF THE INVENTION

1. Field of the Invention

The present invention relates to structural members used in the construction of floor, roof and sides of buildings or the like and, more particularly, to bolted joists and a method of manufacturing the same.

2. Description of the Prior Art

Since the 1950's, open web metal joists are often used in the construction of floors and roofs for commercial, industrial and residential buildings. Such open-web joists are generally formed of metal chords interconnected by metal webs. The opposed ends of the metal webs are generally welded to corresponding ones of the chords by an imposing number of welders who assemble each joist manually with the help of jigs. This manufacturing process requires specialized labor and is relatively expensive.

Trust girders having bolted connections are known in the art. For instance, U.S. Pat. No. 513,187 issued on Jan. 23, 1894 to Joly discloses a trust girder comprising upper and lower chords interconnected by means of a succession of tubular vertical members and diagonal members having angularly extending foot portions. Tie rods extend through the tubular members, the foot portions of the diagonal members and through the chords. Nuts are threadably engaged on the threaded ends of the rods to secure the chords, the vertical and diagonal members together.

SUMMARY OF THE INVENTION

It is therefore an aim of the present invention to provide a new bolted metal joist which avoids the drawbacks of known welded metal joists.

It is also an aim of the present invention to provide a novel method for manufacturing metal joists.

It is a further aim of the present invention to provide a metal joist which is relatively strong and yet lightweight.

It is a still further aim of the present invention to provide a bolted metal joist which is relatively simple and economical to manufacture.

It is a still further aim of the present invention to provide a metal joist which can be conveniently shipped in a minimum of space.

Therefore, in accordance with the present invention, there is provided a joist comprising lower and upper vertically spaced-apart chords rigidly interconnected by a succession of tension and compression webs extending between the chords, each said compression web having lower and upper angularly extending flat end portions which are respectively independently bolted to a top surface of said lower chord and an angularly extending lower flat end portion of an adjacent one of said tension webs, and to an undersurface of said upper chord and an angularly extending upper flat end portion of another adjacent one of said tension webs.

In accordance with a further general aspect of the present invention, there is provided a joist comprising upper and lower vertically spaced-apart chords rigidly interconnected by a succession of tension and compression webs extending between the chords, said upper and lower chords being each formed of a pair elongated strips having substantially L-shaped cross-sections, said strips having parallel spaced-apart vertical legs and opposed horizontal legs, said vertical legs having a plurality of longitudinally spaced-apart holes defined therein, said tension and compression webs having opposed lower and upper flat end portions respectively received between said vertical legs of said upper chord and said lower chord, each said compression web having first and second holes respectively defined in said upper and lower flat end portions thereof, said first hole being in registry with a corresponding hole defined in said upper flat end portion of an adjacent tension web and corresponding holes in said vertical legs of said upper chord for receiving a bolt, said second hole being in registry with a corresponding hole defined in said lower flat end portion of another adjacent tension web and corresponding holes in said vertical legs of said lower chord for receiving a bolt.

In accordance with a further general aspect of is the present invention, there is provided a method of manufacturing joists comprising the steps of: providing a plurality of chords, advancing said chords in a substantially continuous manner to a die punch station where holes are defined in said chords at specific locations therealong according to a predetermined pattern, advancing said chords from said die punch station to a selected one of a shipping station and an assembly station, providing a plurality of elongated webs, advancing said webs in a substantially continuous manner to a forming station where said webs are flattened at opposed end portions thereof and where holes are defined at specific locations in said opposed end portions, advancing said webs from said forming station to a selected one of said shipping station and an assembly station, and assembling metal joists by bolting pairs of prefabricated chords with prefabricated webs.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
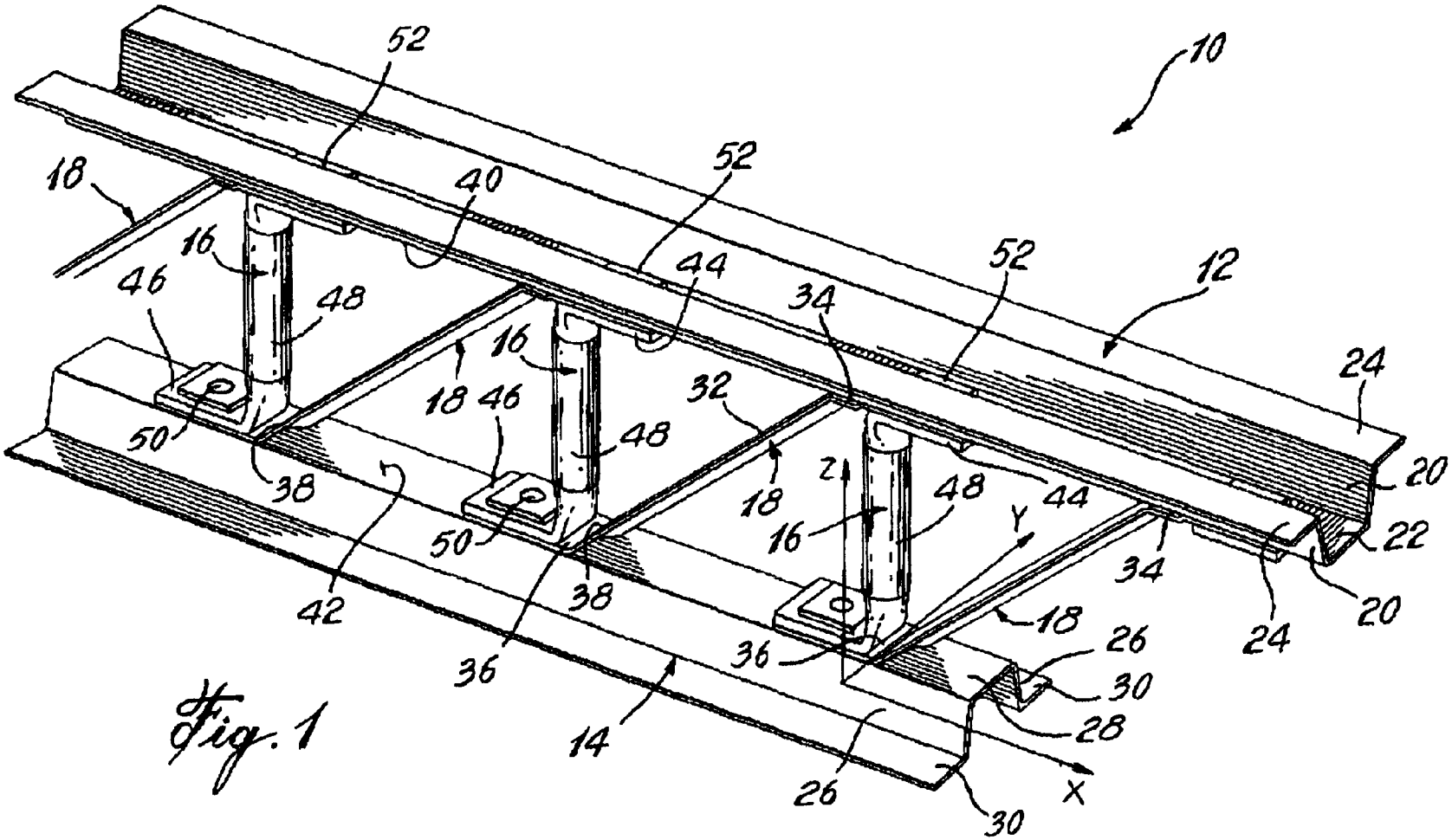
FIG. 1 is a perspective view of a portion of a bolted metal joist having upper and lower chords, tension diagonal webs extending between the upper and lower chords and compression vertical webs pressing the tension diagonal webs to the chords in accordance with a first embodiment of the present invention.
Figure 2:
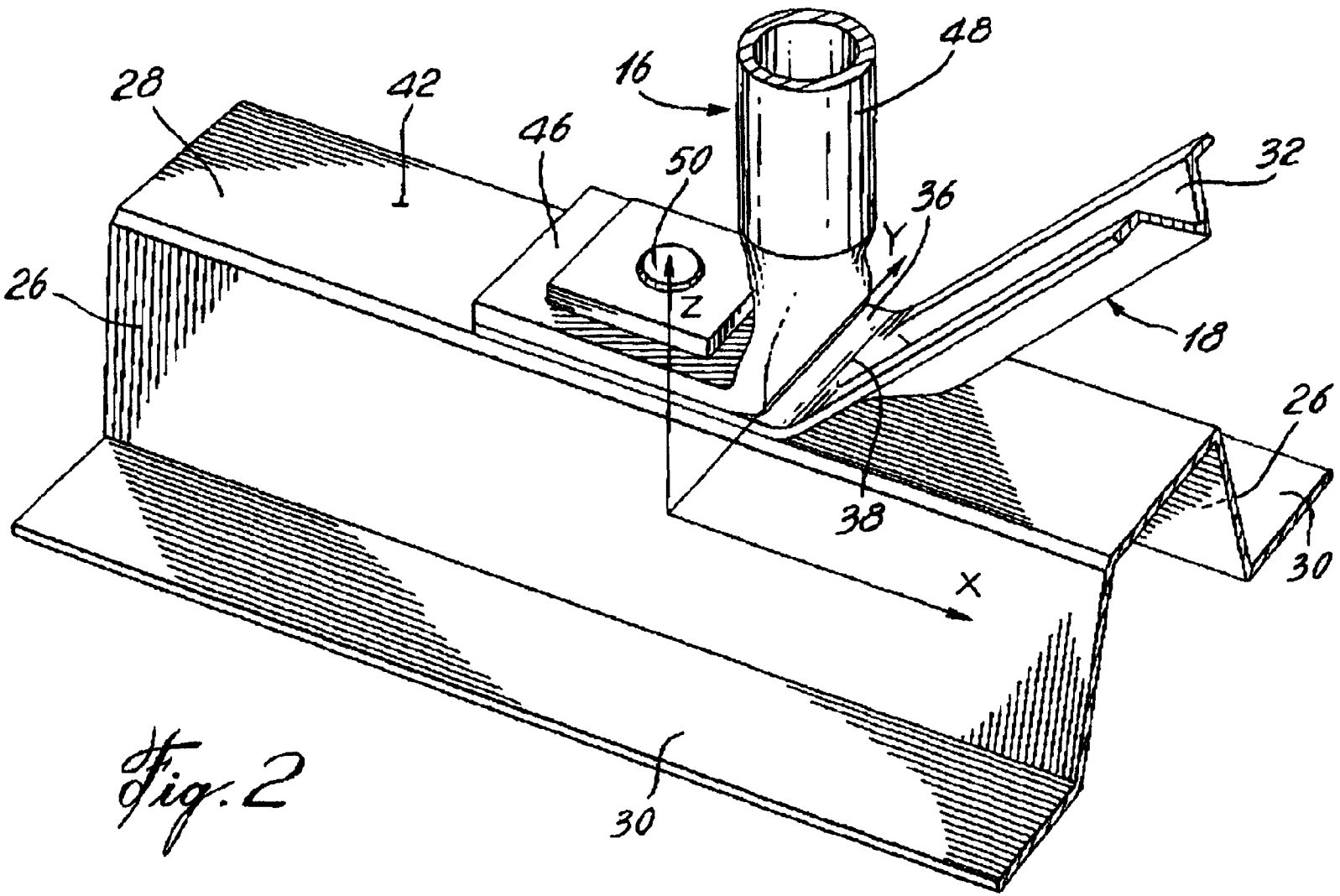
FIG. 2 is an enlarged perspective view of a bolted connection of the metal joist of FIG. 1.

FIGS. 1 and 2 illustrate a bolted metal joist 10 formed of an upper chord 12 and a lower chord 14 interconnected by a succession of compression and tension metallic webs 16 and 18.

As seen in FIG. 1, the upper and lower chords 12 and 14 are preferably formed of an extruded metal, such as steel, and can respectively consist of an inverted top hat channel member and a bottom hat channel member. The upper chord 12 has a pair of side walls 20 flaring upwardly from a base wall 22 and merging at respective distal ends thereof into outwardly extending flanges 24. Similarly, the lower chord 12 has a pair of side walls 26 flaring downwardly from a base wall 28 and merging at respective distal ends thereof into outwardly extending flanges 30. The base walls 22 and 28 of the upper and lower chords 12 and 14 each have a plurality of longitudinally spaced-apart holes (not shown) defined therein for allowing bolt connections, as will be explained hereinafter.

As seen in FIG. 1, the tension webs 18 extend diagonally between the upper and lower chords 12 and 14. Each tension web 18 includes a main intermediate section 32 having, for instance, a V-shaped cross-section and opposed flattened end portions 34 and 36 bent in opposed directions along respective fold lines 38. The flattened end portions 34 and 36 extend in parallel opposed directions at an appropriate angle relative to the main intermediate section 32. The flattened end portions 34 and 36 are respectively positioned against an undersurface 40 of the base wall 22 of the upper chord 12 and a top surface 42 of the base wall 28 of the lower chord 14. The flattened end portion 34 defines a hole (not shown) registering with a corresponding hole (not shown) defined in the base wall 22 of the upper chord 12. Likewise, the flattened end portion 36 defines a hole (not shown) which is in registry with a corresponding hole defined in the base wall 28 of the lower chord 14.

The compression webs 16 have a generally Z shape and extend between the upper and lower chords 12 and 14 in substantially perpendicular relation with respect thereto. Each tension web 1s includes a pair of flattened end portions or foot portions 44 and 46 extending in opposed parallel directions from the opposed ends of an upstanding tubular section 48 so as to respectively press the upper flattened end portion 34 of an adjacent tension web 18 against the undersurface 40 and the lower flattened end portion 36 of another adjacent tension web 18 against the top surface 42 of the lower chord 14. It is noted that the upstanding section 48 does not necessarily have to be tubular. The compression webs 16 could be formed from bars, elongated extruded members having rectangular, square, V-shaped or U-shaped cross-sections.

The flattened end portions 44 and 46 are bent at right angles in opposed directions relative to the tubular upstanding section 48. The upper flattened end portion 44 of each compression web 16 defines a hole (not shown) registering with the registering holes (not shown) of the upper flattened portion 34 of an adjacent tension web 18 and the upper chord 12 in order to receive a bolt (such as the ones shown at 50 in FIG. 2) therein, and the lower flattened end portion 46 of the same compression web 16 defines a hole (not sown) which is in registry with the registering holes (not shown) of the lower flattened end portion 36 of another adjacent tension web 18 and the lower chord 14 in order to receive another bolt 50. Load transferring members 52, such as jam nuts, are threadably engaged on the bolts So to rigidly secure the chords 12 and 14 and the tension and compression webs 16 and 18 together.

As seen in FIG. 1, the respective flattened end portions 34/44 and 36/46 of the tension and compression webs 18 and 16 are oriented in the same direction along the chords 12 and 14 and arranged so that, for each bolt connection (such as the one illustrated in FIG. 2), the upstanding tubular section 48 of the compression webs 16 are disposed between the bolt 50 and the adjacent fold line 38 (i.e. the proximal end of the flattened end portions 34 and 36) and as close as possible to the latter. The distance between the fold line 38 and the upstanding tubular section 48 can be equal to zero or more. By varying this distance, it becomes possible to adjust the natural frequency of the joist 10. This arrangement of the compression and tension webs 16 and 18 at the bolt connections or nodal points advantageously ensures an equilibrium of the diagonal and vertical forces in a vertical direction, whereby the only force to be carried by the bolts is the horizontal component of the force exerted at each nodal point. The vertical component of the forces at each nodal point is completely and directly transferred to the upstanding section 48 of the compression webs 16 and, thus, the bolts 50 only work in shear.

The above described arrangement of the compression and tension webs 16 and 18 is also advantageous in that a single bolt 50 per connection can be used for standard joist applications.

Figure 3:
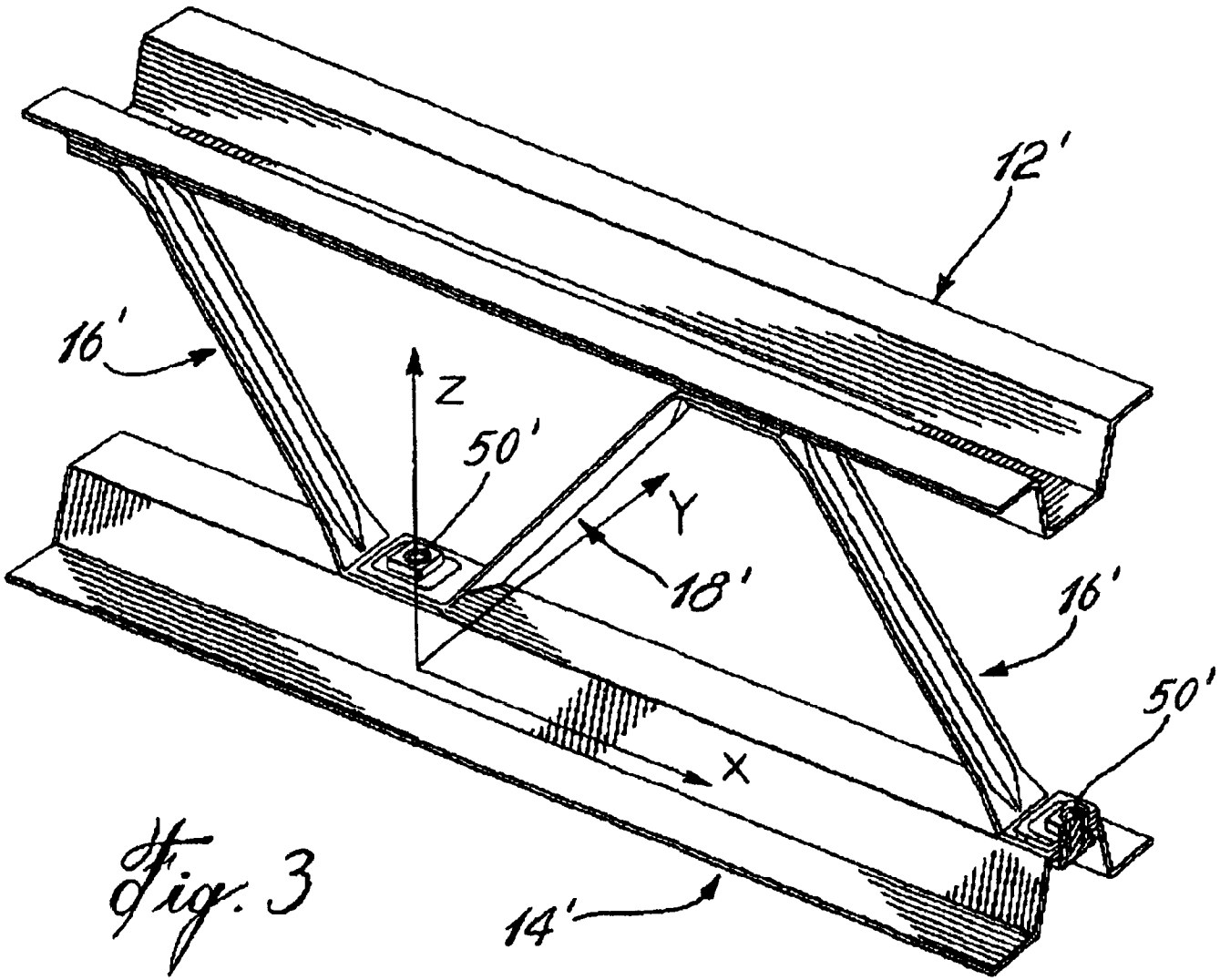
FIG. 3 is a perspective view of a portion of a bolted metal joist having upper and lower chords, tension diagonal webs extending between the lower and upper chords and compression diagonal webs pressing the tension diagonal webs to the chords in accordance with a second embodiment of the present invention.
Figure 4:
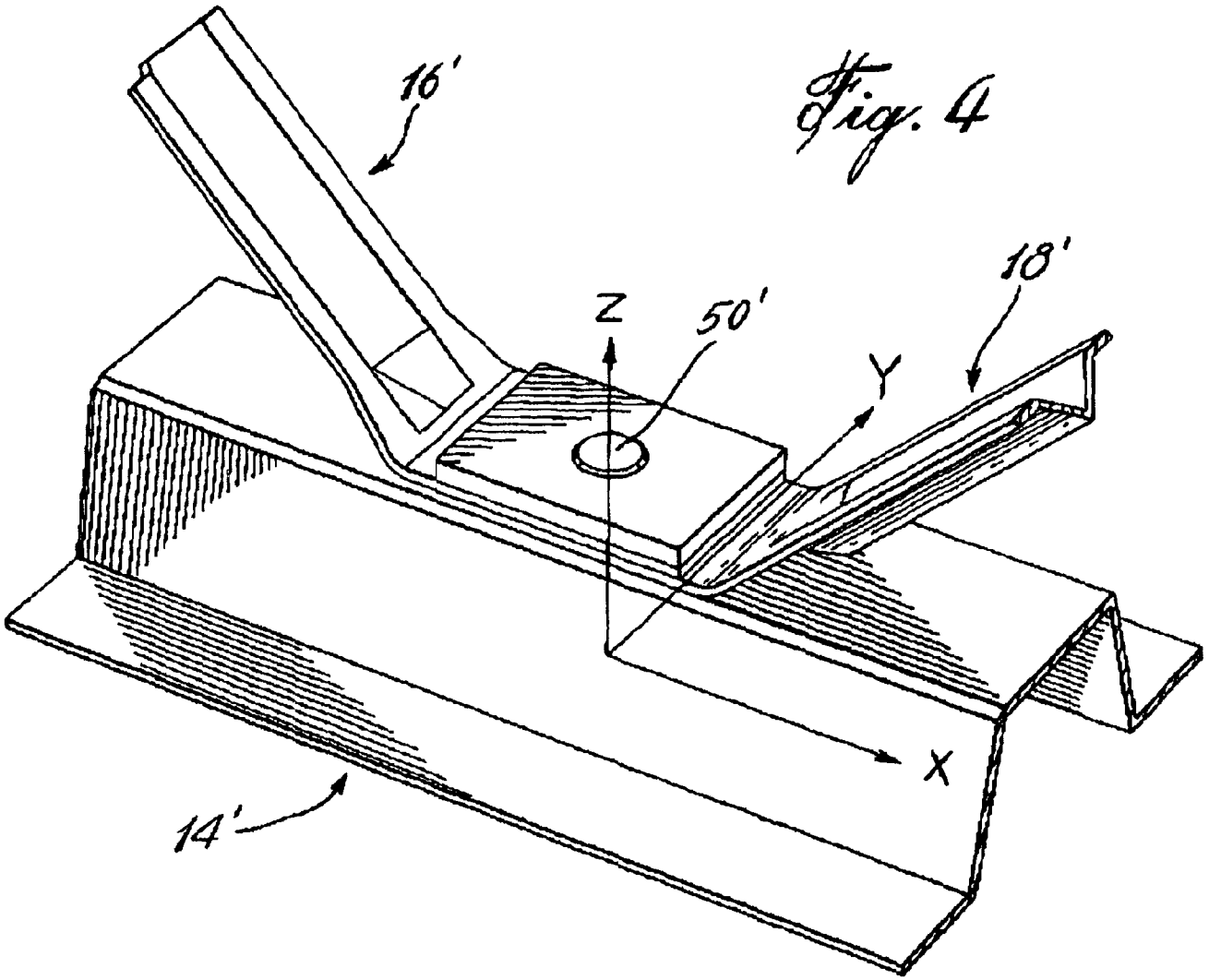
FIG. 4 is an enlarged perspective view of a bolted connection of the metal joist illustrated in FIG. 3.
Figure 5:
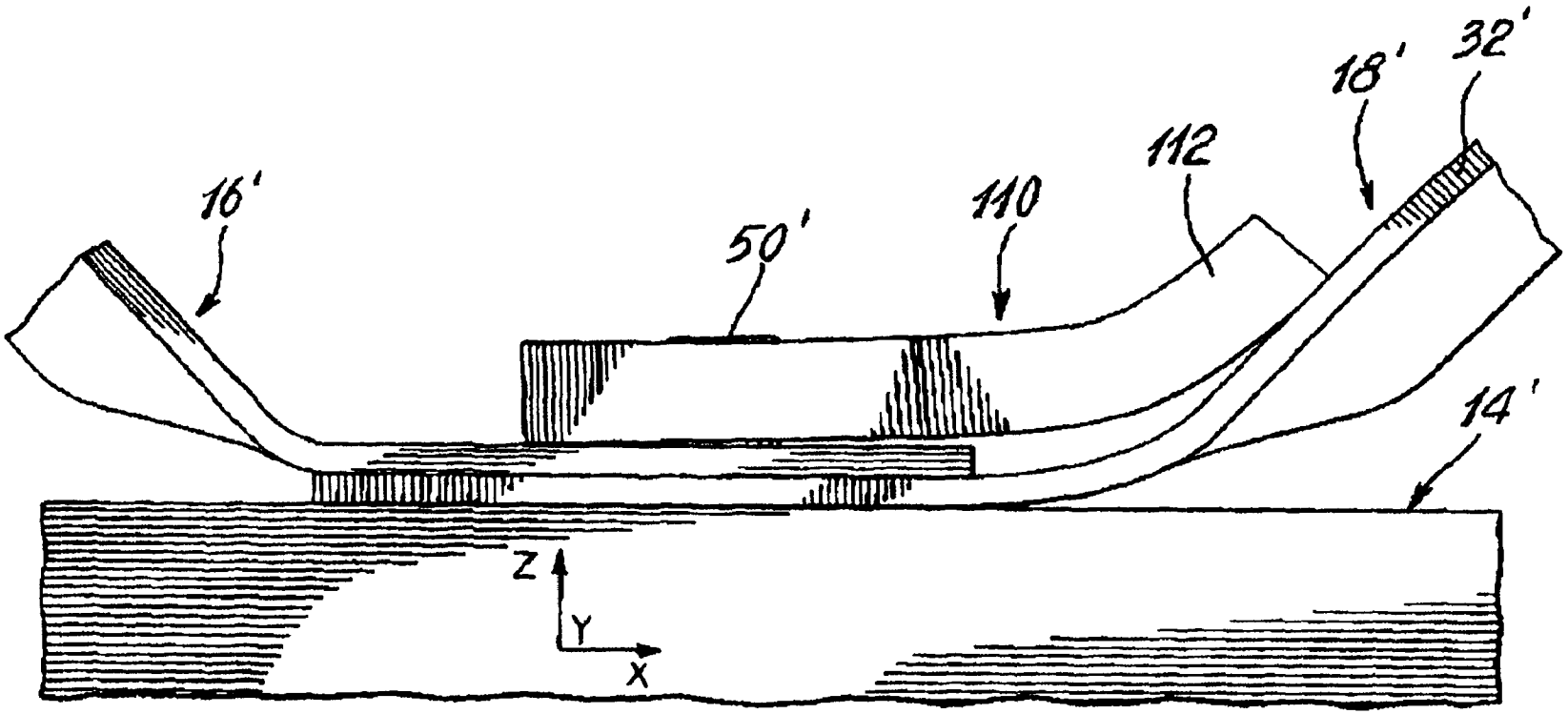
FIG. 5 is an enlarged side view of a bolted connection with an eccentric washer at a nodal point of a bolted metal joist.

In the following description which pertains to the embodiment of FIGS. 3 to 5, components which are identical in function and identical or similar in structure to corresponding components of the bolted metal joist 10 bear the same reference numeral as in FIGS. 1 and 2 but are tagged with the suffix "'" whereas components which are new to the embodiment of FIGS. 3 to 5 are identified by new reference numerals in the hundreds.

FIGS. 3 and 4 illustrate a second embodiment of the present invention wherein the vertical compression webs 16 have been replaced by diagonal compression webs 16' having structural characteristics similar to those of the tension webs 18 and 18'.

The compression and tension webs 16' and 18', respectively, are successively mounted in an alternate fashion between the upper and lower chords 12' and 14' and oriented in opposed direction with respect to each other so as to define a succession of "V" and inverted "V", the respective apexes of which correspond to the nodal points. The chords 12' and 14', the compression webs 16' and the tension webs 18' are secured together at each nodal point by a single grip bolt acting in both shear and tension.

As seen in FIG. 5, an optional load transferring member, such as an eccentric metallic washer 110, can be advantageously used to reduce local deformations when the joist 10' is under loaded conditions. The eccentric washers 110 advantageously allow to change and adjust the natural frequency of the joist 10' without virtually increasing the weight thereof.

The eccentric washer 110 defines a hole (not shown) for receiving a bolt 50', the hole being offset relative to a central point of the washer 110. The washer 110 has an angularly extending projection 112 adapted to bear against the inclined intermediate section 32' of an associated tension web 18'. As seen in FIG. 5, the projection 112 of the washer 110 is maintained firmly against the intermediate section 32' by the bolt 50' so as to offer an opposition to local deformations in the tension web 18' in the vicinity of the nodal point.

It is contemplated to use joists of the type described hereinbefore in combination with a concrete slab (not shown). In this case the bolts 50/50' would extend into the concrete slab to act as studs for obtaining a composite action between the concrete slab and the metal joists 10/10'. The top chord 12/12' would be preferably inverted with the surface 40 of the base wall 22 thereof acting as a support surface for the concrete slab.

Figure 6:
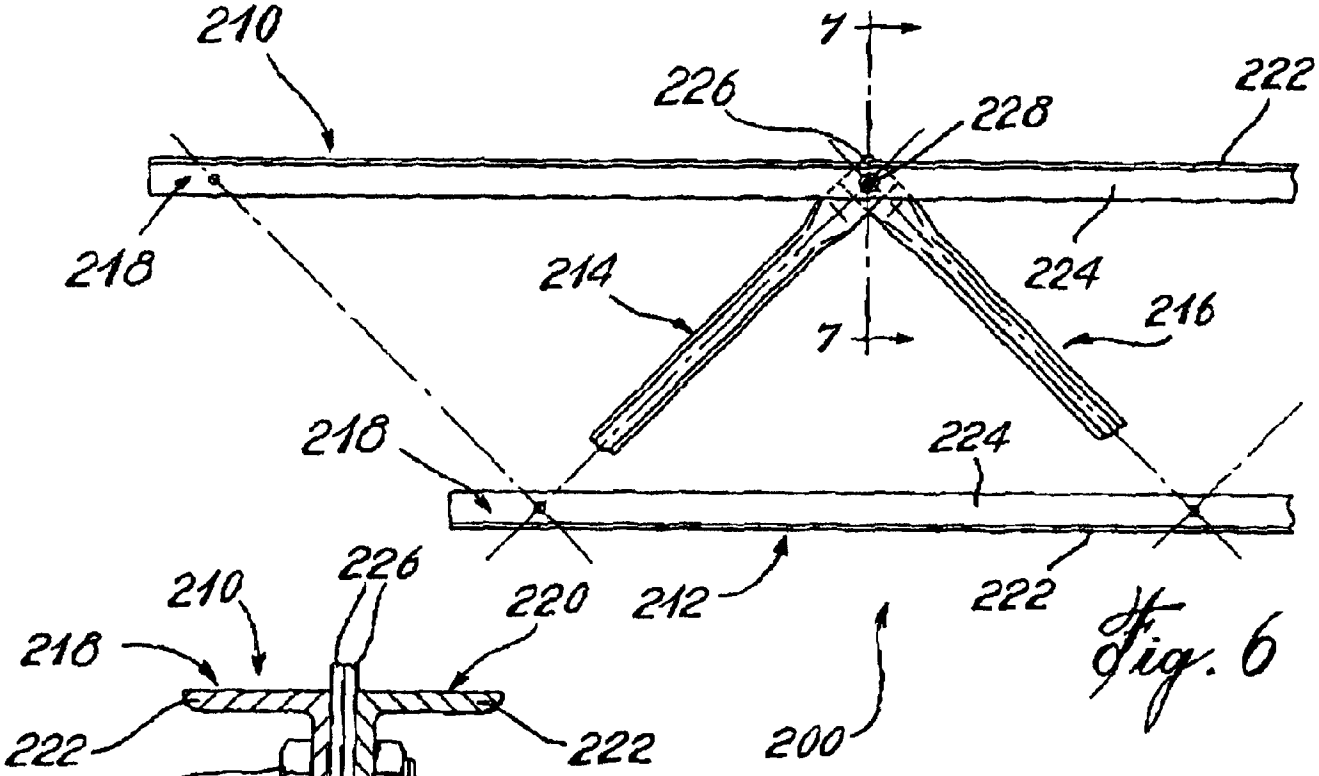
FIG. 6 is a perspective view of a portion of a bolted metal joist having upper and lower chords, and tension and compression diagonal webs extending between the chords in accordance with a third embodiment of the present invention.
Figure 7:
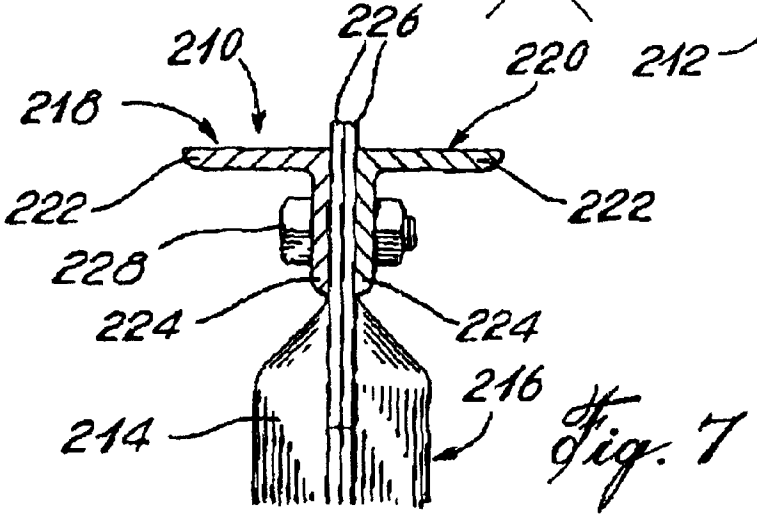
FIG. 7 is a cross-sectional view taken along line 7—7 in FIG. 6.

FIGS. 6 and 7 illustrate a bolted metal joist 200 in accordance with a third embodiment of the present invention. The bolted metal joist 200 generally comprises an upper chord 210 and a lower chord 212 interconnected by a succession of compression and tension webs 214 and 216 extending in opposed diagonal directions between the upper and lower chords 210 and 212.

The upper chord 210 and the lower chord 212 are each made of a pair of angle iron strips 218 and 220. The angle iron strips 218 and 220 are each provided with a horizontal leg 222 and a vertical leg 224, with the horizontal leg 222 of each pair of strips 218 and 220 being in alignment and with the vertical legs 224 being spaced apart to define a gap therebetween. The vertical legs 224 have a plurality of longitudinally spaced-apart bolt holes (not shown) defined therein.

The tension and compression webs 214 and 216 are typically each formed from an elongated tubular member having opposed axially extending flattened end portions 226 in each of which a hole (not shown) is defined for registering with corresponding holes in the upper and lower chords 210 and 212. The flattened end portions 226 are configured to be received in pairs in the gap defined between the vertical legs 224 of the pair of iron angle strips 218 and 220 and are secured thereto by means of grip bolts 228, each of which extends transversally of the joist 200 and through the registering holes of a pair of vertical legs 224 and of a pair of superimposed flattened end portions 226 received therebetween. A single grip bolt 228 is provided at each nodal point to secure the chords 210 and 212 and the webs 214 and 216 together.

It is noted that the compression webs 214 could be vertical instead of being diagonal as in FIG. 6.

Bolting the chords and the webs together, as per the way described hereinbefore, instead of welding, advantageously allows for the automation of the manufacturing process of metal joists. Furthermore, it allows to selectively assemble the joists in a shop or on site without requiring highly qualified labor.

Figure 8:
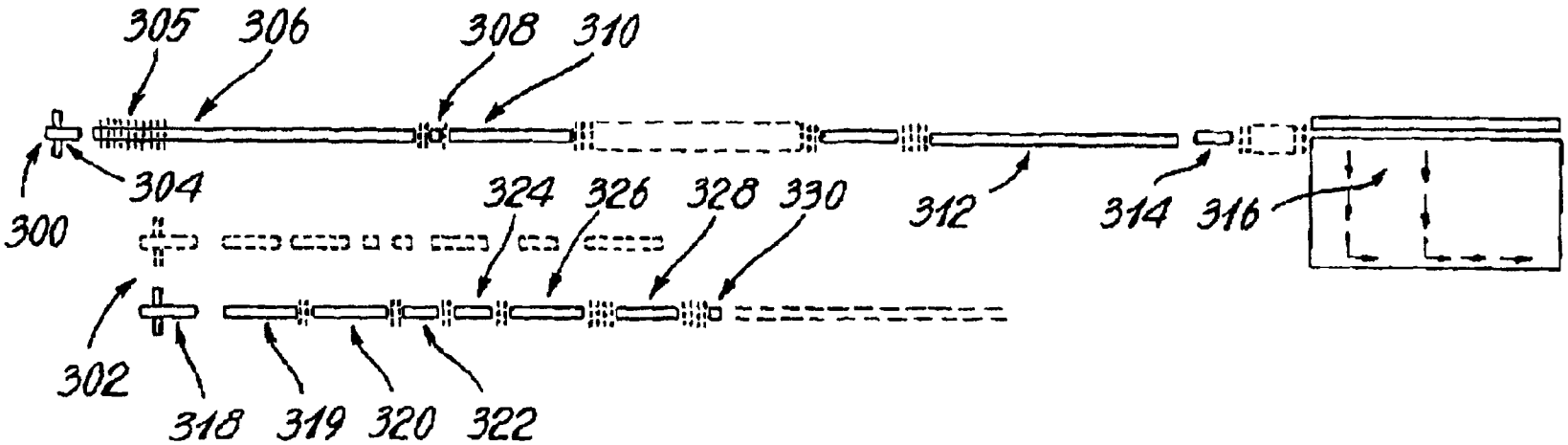
FIG. 8 is a schematic top plan view of a joist production plant.

As seen in FIG. 8, the bolted metal joists are manufactured on two complementary chains of operations that can operate simultaneously on separate production lines 300 and 302. On the first line 300, the upper and lower chords of the bolted steel joist are fabricated, whereas on the second line 302, the web members are produced.

The chords are typically manufactured from rolls of metal sheets of a specified width. The rolls are mounted on supply reels, such as at 304 and then passed to a straitening station 305. The rolls are profiled by a mechanical roll former 306 and advanced to a cutting station 308 where the unrolled metal sheets are cut into chords having predetermined lengths. It is noted that the chords could also be rolled up directly at the mill.

On a mechanical conveyor, the chords are identified by numerically controlled presses and then holes are perforated at predetermined locations on the chords at a punching die station 310.

Then, the chords are advanced to an optional cleaning cabinet 312 where they are sand-blasted or blasted with steel grid.

From there, the chords are transferred to a painting station 314 where they are spray-painted by numerically controlled machines.

Once, the chords have been painted, they are advanced to an infrared oven 316 where the paint dries instantly. This step takes about 1 to 2 minutes.

When the paint has dried, the lower and upper chords of the steel joists are transferred to an assembly unit and/or to a shipping area.

The steel required for the webs is typically received in the form of rolls or bars. Supply reels, such as at 318, are provided for supporting the rolls. A straightening unit 319 is typically provided downstream of the supply reels 318 to straighten the roll of metal sheet. The sheet or bars are then advanced to an optional cleaning station 320 where they are sand-blasted. Then, the webs are advanced to an identification station 322 where identification indicia are applied to the webs. From there, the webs are advanced to a cutting station 324 where the webs are cut to a predetermined length. Thereafter, the ends of webs are flattened, folded and perforated at a forming station 326. The holes in the webs can be made with a punching die. The perforated webs are then transferred to a painting basin 328 where the excess paint is automatically air blasted. The excess falls in the basin 328 such that it can be re-used. This way, there is no loss of paint or pollution.

The painted webs are advanced from the basin 328 to an infrared oven 330 where the paint dries automatically. When this step is completed, the webs of the bolted metal joists are transferred to the assembly unit and/or to the shipping area.

There is typically two shipping options:

Short distance: the steel joists can be assembled at the plant prior to their shipping on the field by conventional transportation.

Long distance: the steel joists can be shipped unassembled and be assembled on site by the customer.

By introducing bolted connections and creating a new manufacturing process of joists and integrating in it the now available automated production technologies, it has been found that joists of superior quality can be produced while reducing the manufacturing cost.

It is noted that the above described bolted joists could be made of a material different than metal, as long as the selected material has sufficient structural properties.

What is claimed is:

1. A joist comprising lower and upper vertically spaced-apart chords rigidly interconnected by a succession of alternating and continuously interengaged tension and compression webs extending between the chords, each one of said compression webs being disposed between and linking successive tension webs such that a lower end portion of any given compression web presses a lower end portion of a first adjacent tension web against a top surface of said lower chord thereby forming a lower node, and an upper end portion of said any given compression web presses an upper end portion of a second adjacent tension web against an undersurface of said upper chord thereby forming an upper node, and said lower and upper nodes being respectively fastened to said lower chord and said upper chord, wherein said lower end portions and said upper end portions respectively comprise lower and upper angularly extending flat end portions, each of said compression webs having a first hole defined in said lower flat end portion thereof, said first hole being in registry with a first pair of corresponding holes respectively defined through said top surface of said lower chord and said lower flat end portion of said adjacent one of said tension webs, said first hole being placed in registry with said first pair of corresponding holes for receiving a bolt therein, and wherein each of said compression webs has a second hole defined in said upper flat end portion thereof, said second hole being in registry with a second pair of corresponding holes respectively defined through said undersurface of said upper chord and said upper flat end portion of said other adjacent one of said tension webs, said second hole being placed in registry with said second pair of corresponding holes for receiving a bolt therein, wherein each of said compression and tension webs includes an intermediate section extending between said lower and upper angularly extending flat end portions thereof, said lower and upper flat end portions extending in opposed parallel directions relative to said intermediate section, wherein said lower and upper flat end portions of each said compression web respectively extend inwardly of a corresponding lower flat end portion of said adjacent one of said tension webs and a corresponding upper flat end portion of said another adjacent one of said tension webs, and wherein said, intermediate section of each said compression web extends from said lower flat end portion thereof at a location comprised between said first hole and a proximal end of said corresponding lower flat end portion of said adjacent one of said tension webs to said upper flat end portion at a location comprised between said second hole and a proximal end of said corresponding upper flat end of said another adjacent one of said tension webs, thereby preventing transmission of tensile forces to said bolts, and wherein said intermediate section of each compression web extends substantially at right angles to said lower and upper flat end portions thereof.

2. A joist as defined in claim 1, wherein said tension and compression webs are connected to each other and to said upper and lower chords at said upper and lower nodes by way of a single bolt at each node.

3. A joist as defined in claim 1, wherein each said compression web is generally Z-shaped.

4. A joist as defined in claim 1, wherein said tension and compression webs extend in opposed diagonal directions relative to said lower and upper chords.

5. A joist as defined in claim 4, wherein each of said bolts also extends through a load transferring member disposed to engage an adjacent one of said tension web to reduce local deformations at the points of connection due to loads applied onto the joist.

6. A joist as defined in claim 5, wherein each said load transferring member has an angularly extending projection configured to bear against a corresponding intermediate section of one of said tension webs.

7. A joist as defined in claim 6, wherein each said load transferring member defines a hole for receiving one of said bolts, said hole being offset relative to a central point of said load transferring means.

8. A joist as defined in claim 7, wherein each said load transferring member is provided in the form of an eccentric washer.

9. A joist as defined in claim 4, wherein all of said tension webs are parallel to each other, and all of said compression webs are parallel to each other.

10. A joist comprising lower and upper vertically spaced-apart chords rigidly interconnected by a succession of alternating and continuously interengaged tension and compression webs extending between the chords, each one of said compression webs being disposed between and linking successive tension webs such that a lower end portion of any given compression web presses a lower end portion of a first adjacent tension web against a top surface of said lower chord thereby forming a lower node, and an upper end portion of said any given compression web presses an upper end portion of a second adjacent tension web against an undersurface of said upper chord thereby forming an upper node, and said lower and upper nodes being respectively fastened to said lower chord and said upper chord, wherein said lower end portions and said upper end portions respectively comprise lower and upper angularly extending flat end portions, each of said compression webs having a first hole defined in said lower flat end portion thereof, said first hole being in registry with a first pair of corresponding holes respectively defined through said top surface of said lower chord and said lower flat end portion of said adjacent one of said tension webs, said first hole being placed in registry with said first pair of corresponding holes for receiving a bolt therein, and wherein each of said compression webs has a second hole defined in said upper flat end portion thereof, said second hole being in registry with a second pair of corresponding holes respectively defined through said undersurface of said upper chord and said upper flat end portion of said other adjacent one of said tension webs, said second hole being placed in registry with said second pair of corresponding holes for receiving a bolt therein, wherein each of said compression and tension webs includes an intermediate section extending between said lower and upper angularly extending flat end portions thereof, said lower and upper flat end portions extending in opposed parallel directions relative to said intermediate section, wherein said tension and compression webs extend in opposed diagonal directions relative to said lower and upper chords, wherein each of said bolts also extends through a load transferring member disposed to engage an adjacent one of said tension web to reduce local deformations at the points of connection due to loads applied onto the joist, and wherein each said load transforming member has an angularly extending projection configured to bear against a corresponding intermediate section of one of said tension webs.

11. A joist as defined in claim 10, wherein each said load transferring member defines a hole for receiving one of said bolts, said hole being offset relative to a central point of said load transferring means.

12. A joist as defined in claim 11, wherein each said load transferring member is provided in the form of an eccentric washer.

* * * * *